United States Patent [19]

Tholen

[11] 4,356,796

[45] Nov. 2, 1982

[54] COOLING SYSTEM FOR HYDRONAMIC RETARDER OF INTERNAL COMBUSTION ENGINE

[75] Inventor: Paul Tholen, Gladbach, Fed. Rep. of Germany

[73] Assignee: Klockner-Humboldt-Deutz AG, Cologne, Fed. Rep. of Germany

[21] Appl. No.: 237,114

[22] Filed: Feb. 23, 1981

[30] Foreign Application Priority Data

Feb. 27, 1980 [DE] Fed. Rep. of Germany ..... 3007346

[51] Int. Cl.[3] ..... F01P 1/06

[52] U.S. Cl. ..... 123/41.31; 123/41.59; 123/41.7

[58] Field of Search ..... 123/41.04, 41.05, 41.31, 123/41.58, 41.59, 41.7, 41.65, 41.66; 236/35.2; 180/54 A, 69 R

[56] References Cited

U.S. PATENT DOCUMENTS 1,705,710 3/1929 Bindon ..... 180/69 R 2,089,288 8/1937 Moorhouse ..... 236/35.2

2,143,889 1/1939 Ledwinka ..... 180/54 A

*Primary Examiner*—William A. Cuchlinski, Jr.

*Attorney, Agent, or Firm*—Watson, Cole, Grindle & Watson

[57] ABSTRACT

An air-cooled internal combustion engine equipped with a hydronamic retarder is combined with a cooling system for the hydronamic retarder fluid. The system comprises a cooling air shroud for directing cooling air past the engine in cooling relationship thereto and a cooling air fan for pushing air through the shroud. The system further includes a retarder oil cooler located upstream from the fan remote from the engine and circuit means are provided for circulating retarder oil through the cooler. Exhaust valves are provided in the shroud and are positioned for diverting at least a portion of the cooling air flow from the shroud when the valves are open. Thus, the overall pressure loss of the system may be decreased and the total flow of cool air through the cooler may correspondingly be increased to increase the cooling efficiency in the cooler.

4 Claims, 3 Drawing Figures

COOLING SYSTEM FOR HYDRONAMIC RETARDER OF INTERNAL COMBUSTION ENGINE

BACKGROUND OF THE INVENTION

1. Field of the Invention

The present invention relates to air-cooled internal combustion engines equipped with at least one hydronamic retarder and in particular to the combination of such an engine and a cooling system for the hydronamic retarder fluid.

2. Description of the Prior Art

Internal combustion engines equipped with hydronamic retarders are well-known and one such engine is described in West German Pat. No. 1,230,615, in which engine the retarder oil cooler is located on the coupling side of the internal combustion engine and in series with the cylinders. This cooler is closed by exhaust valves during the normal operation of the cooler; however, when the retarder is in operation, the exhaust valves are opened whereby the cooling air may flow in the desired direction through the retarder oil cooler. The opening of the exhaust valves, however, causes the pressure in the system to diminish such that a relatively small volume of air flows through the retarder oil cooler and hence, a relatively large cooler must be provided in order to dissipate the heat produced. Such large and bulky retarder oil coolers are difficult to mount in modern automobiles because of the cramped assembly of the latter.

SUMMARY OF THE INVENTION

It is thus an important object of the present invention to provide an improved cooling system for hydronamic retarder fluid which is capable of producing the desired cooling affect and yet is small in size. In accordance with the invention, this object is accomplished through the use, in combination with an air-cooled internal combustion engine equipped with a hydronamic retarder, of a cooling air shroud for directing cooling air past the engine in cooling relationship thereto and a cooling air fan for pushing air through the shroud. A retarder oil cooler means is located on the upstream side of the fan remote from the engine and circuit means are provided for circulating retarder oil through the cooler means. Exhaust valves means are provided in the shroud and are positioned for causing at least a portion of the cooling air flow to be diverted from the shroud when the valve means are open whereby to decrease the overall pressure loss of the system and thereby increase the total flow of cooling air through the cooler. Manifestly, the valve means are operable when the retarder is in operation.

In accordance with the invention, the combination may also include means coupled with the exhaust valves and the retarder oil circuit for controlling the opening of the exhaust valve means as a function of the temperature of the retarder oil. Alternatively, means may be provided for operating the exhaust valve means manually.

The arrangement of the present invention has the advantage, due to the opening of the exhaust valve means when the retarder is in operation, that a substantially larger volume of cooling air flows through the cooler and through the blower and at the same time the volume of cooling air flowing through the motor elements in considerably reduced. This has the additional advantage that when the retarder is in operation, the elements of the motor itself are not cooled substantially. Through the use of the arrangement of the invention, the volume of cooling air may be substantially increased when the exhaust valves are opened without requiring any modification to blower. Thus, the retarder oil cooler itself may be quite small.

BRIEF DESCRIPTION OF THE DRAWINGS

FIG. 1*b* is a schematic, top-plan view of the internal combustion engine of FIG. 1*a.

DETAILED DESCRIPTION OF THE INVENTION

Figure 1A:
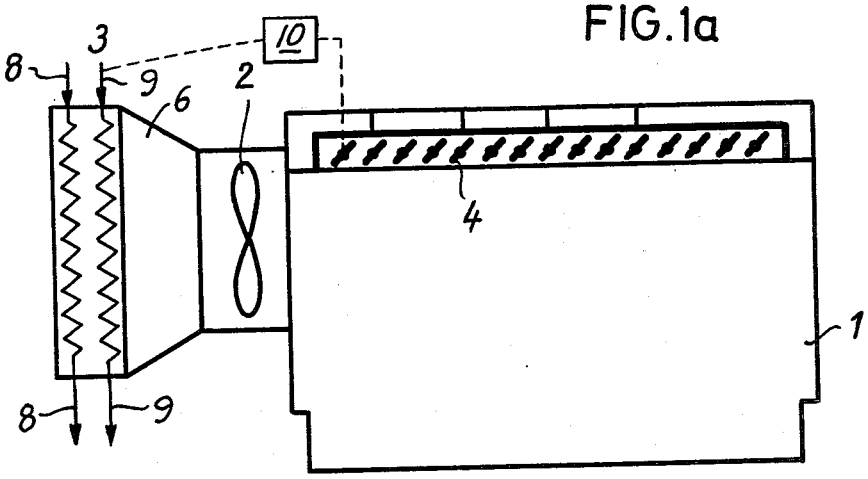
FIG. 1*a* is a schematic, elevational view of an internal combustion engine which is combined with retarder oil cooler means in accordance with the principles and concepts of the present invention.
Figure 1B:
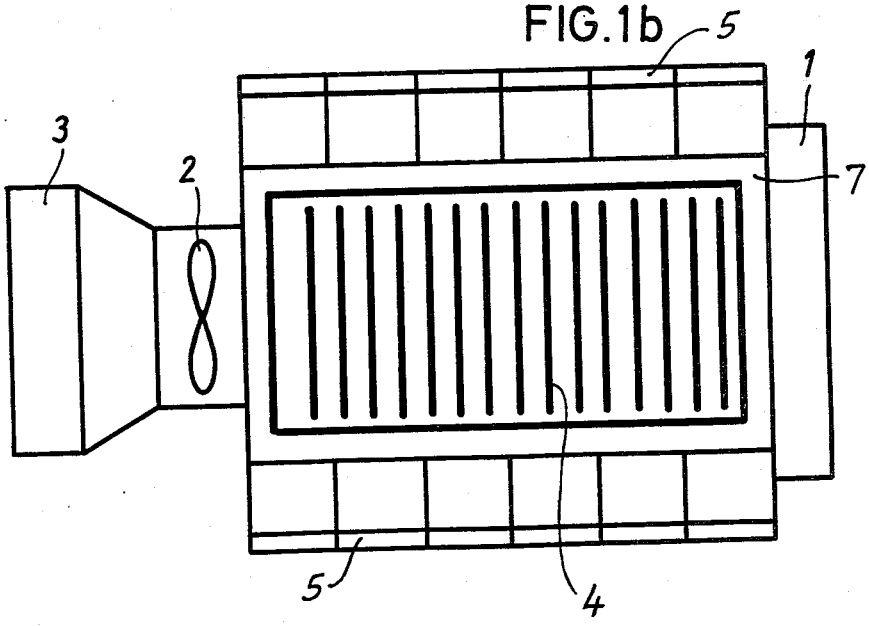

An air-cooled internal combustion engine 1 is schematically illustrated in FIGS. 1*a* and 1*b*. Engine 1 may be a V-type internal combustion engine as shown with two rows of cylinders 5. On the front end of engine 1 is mounted a cooling air fan or impeller 2 which is driven by means of a conventional speed-controlling driving power not shown in the drawing. A retarder oil cooler 3, which is connected to air fan 2 by a hood 6, is mounted on the upstream side of fan 2 remote from engine 1 as can be seen. Circuit means 8, 9 are provided for circulating the retarder oil through cooler 3 in heat exchanging relationship to cooling air pulled therethrough by fan 2.

A cooling air shroud 7 is provided for receiving cooling air from fan 2 and directing the air past engine 1 in cooling relationship thereto. Exhaust valve means, in the nature of a plurality of exhaust valves 4, are mounted in shroud 7 and are positioned for causing at least a portion of the cooling air flow to be diverted from shroud 7 when valves 4 are opened whereby to decrease the overall pressure loss of the system and thereby increase the total flow of cooling air through the cooler without changing the power consumption of fan 2. As can be seen in FIGS. 1*a* and 1*b*, valves 4 are arranged in the manner of a shutter and are capable of rotating about their longitudinal axes whereby to exhaust cooling air from shroud 7.

Figure 2:
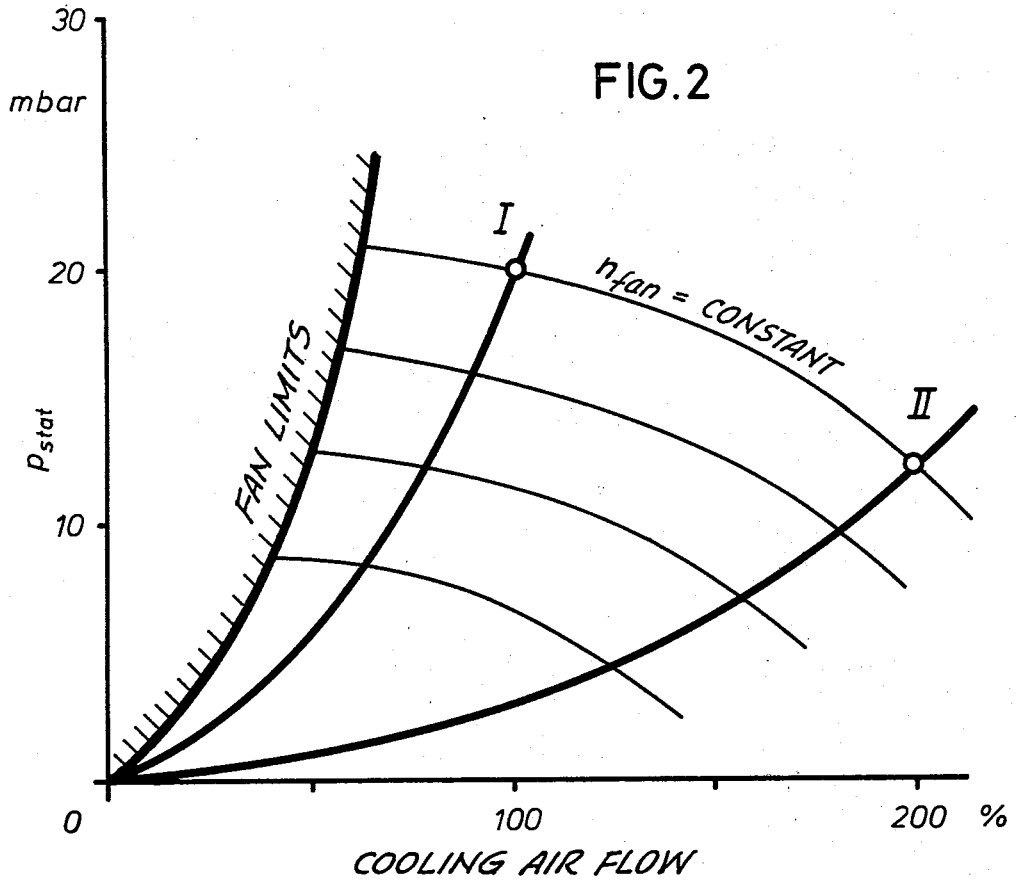
* and FIG. 2 is a graph which illustrates the fan characteristics of the engine of FIGS. 1*a* and 1*b*.

With reference to FIG. 2, fan 2 has two characteristic operating points designated I and II. Operating point I illustrates load characteristics at maximum, full-load speed of the motor, and with exhaust valves 4 closed. As is apparent from the ordinate of the graph, the total static pressure loss through the cooler and shroud 7 is approximately 20 mbar. This results from a pressure loss through the cooler of approximately 2 mbar and a pressure loss through the shroud of approximately 18 mbar. At operating point II, which illustrates the operation characteristics of fan 2 with exhaust valves 4 open but with an identical fan speed, the overall static pressure loss in shroud 7 is reduced substantially whereby the amount of air delivered by fan 2 is increased by approximately 100%. Under these conditions the pressure loss in the cooler is approximately 18 mbar whereas in shroud 7 it is only 4.5 mbar because valves 4 have been opened to reduce the overall resistance in shroud 7.

When valves 4 are closed, the cooling air drawn in by fan 2 flows through shroud 7. When valves 4 are opened, it is possible to nearly double the volume of cooling air as can be seen from FIG. 2. This amount of cooling air fully serves to cool the retarder oil in cooler 3. Accordingly, cooler 3 may be substantially smaller than one which would be required in the absence of exhaust valves 4. On the other hand, the volume of cooling air carried through the entire extent of shroud 7 is reduced to almost ½ of its normal volume. That is to say, approximately 150% of the normal amount of cooling air (that is air flow normally supplied at full load with exhaust valves 4 closed) is conducted through open valves 4; whereas only 50% of the full-load, normal air flow flows through shroud 7 to cool the engine. Thus, the engine is not cooled abnormally when the retarder is in operation and valves 4 are open.

It goes without saying that cooler 3 may also be employed to cool gear-oil during normal vehicle operation. In such case the cooler 3 will heat the cooling air only slightly and the overall efficiency of the engine is not adversely affected. The gear-oil may be supplied to cooler 3 via circuit means 8 as illustrated in FIG. 1*a*.

Advantageously, the opening of exhaust valves 4 may be coordinated with the operation of the retarder such that the valves are opened at the same time that the retarder is put into operation. This approach involves a design which would be simple to apply in terms of structural engineering. It is also conceiveable to control the valves 4 as a function of the temperature of the retarder oil and/or of a significant motor element. For this purpose control means 10 coupled with exhaust valves 4 and retarder oil circuit 9 may be provided for control of the opening of exhaust valves as a function of the temperature of the retarder oil. Thus, it can be seen that exhaust valves 4 may be controlled hydraulically or pnuematically or by hand as a function of the retarder -oil temperature or simultaneously with the operation of the retarder.

I claim:

1. In combination with an air-cooled internal combustion engine equipped with a hydronamic retarder,
   - a cooling air shroud for directing cooling air past said engine in cooling relationship thereto,
   - a cooling air fan for pushing air through said shround,
   - retarder oil cooler means located on the upstream side of said fan remote from the engine,
   - circuit means for circulating retarder oil through the cooler means, and
   - exhaust valve means positioned in said shroud for causing at least a portion of the cooling air flow to be diverted from the shroud when the valve means are opened whereby to decrease the overall pressure loss of the system and thereby increase the total flow of cooling air through the cooler, said valve means being openable only when the retarder is in operation.

2. The combination of claim 1, and means coupled with the exhaust valves and the retarder oil circuit for controlling the opening of the exhaust valves means as a function of the temperature of the retarder oil.

3. The combination of claim 1, and means for operating said exhaust valve means manually.

4. The combination of claim 1, and circuit means for circulating gear oil through the cooler means.

* * * * *